US010788027B2

(12) United States Patent
Kawai

(10) Patent No.: US 10,788,027 B2
(45) Date of Patent: Sep. 29, 2020

(54) ELECTRIC AIR PUMP

(71) Applicant: DENSO CORPORATION, Kariya-shi, Aichi-ken (JP)

(72) Inventor: Keita Kawai, Toyohashi (JP)

(73) Assignee: DENSO CORPORATION, Kariya-Shi, Aichi (JP)

( * ) Notice: Subject to any disclaimer, the term of this patent is extended or adjusted under 35 U.S.C. 154(b) by 131 days.

(21) Appl. No.: 15/776,789

(22) PCT Filed: Nov. 16, 2016

(86) PCT No.: PCT/JP2016/084007
§ 371 (c)(1),
(2) Date: May 17, 2018

(87) PCT Pub. No.: WO2017/086359
PCT Pub. Date: May 26, 2017

(65) Prior Publication Data

US 2018/0372078 A1 Dec. 27, 2018

(30) Foreign Application Priority Data

Nov. 19, 2015 (JP) ..... 2015-226909
Jul. 26, 2016 (JP) ..... 2016-146537

(51) Int. Cl.
*F04B 35/01* (2006.01)
*F04B 35/04* (2006.01)
*F04B 39/12* (2006.01)
*F04B 41/00* (2006.01)
(Continued)

(52) U.S. Cl.
CPC ..... *F04B 35/01* (2013.01); *F04B 35/04* (2013.01); *F04B 39/00* (2013.01); *F04B 39/12* (2013.01); *F04B 41/00* (2013.01); *F04B 49/065* (2013.01)

(58) Field of Classification Search
CPC ..... F04B 35/00; F04B 35/01; F04B 35/04; F04B 39/12; F04B 39/0016;
(Continued)

(56) References Cited

U.S. PATENT DOCUMENTS 1,624,423 A * 4/1927 Milton ..... F04B 1/02 417/419
4,416,588 A * 11/1983 Karliner ..... B05B 7/32 417/199.1
(Continued)

FOREIGN PATENT DOCUMENTS

JP 2002-138955 A 5/2002
JP 3101177 U 2/2004
(Continued)

*Primary Examiner* — Nathan C Zollinger
(74) *Attorney, Agent, or Firm* — Solaris Intellectual Property Group, PLLC

(57) ABSTRACT

An electric air pump is provided that includes (i) a motor that includes a rotary shaft provided with a worm, (ii) a crank that includes a worm wheel which engages with the worm and a rod with one end rotatably coupled to the worm wheel, and (iii) a piston that is housed in a cylinder extending along an axial direction of the motor, that is coupled to another end of the rod and moves back and forth along an extension direction of the cylinder due to actuation of the crank, and that ejects air inside the cylinder from a valve provided at one end of the cylinder due to being moved toward the one end side of the cylinder.

9 Claims, 4 Drawing Sheets

(51) Int. Cl.
*F04B 39/00* (2006.01)
*F04B 49/06* (2006.01)

(58) Field of Classification Search
CPC ..... F04B 39/0094; F04B 41/00; F04B 27/10; F04B 49/065; F04B 9/02; F04B 17/03; F04B 53/144
See application file for complete search history.

(56) References Cited

U.S. PATENT DOCUMENTS

| | | | | | |
|---|---|---|---|---|---|
| 4,656,687 | A * | 4/1987 | Wei | A47L 5/24 | 15/324 |
| 4,936,747 | A * | 6/1990 | Mitsuhashi | F04B 49/10 | 340/679 |
| 5,165,869 | A * | 11/1992 | Reynolds | F04B 43/009 | 417/385 |
| 5,195,427 | A * | 3/1993 | Germano | B65B 31/047 | 141/65 |
| 6,439,104 | B1 * | 8/2002 | Tonogai | F04B 35/01 | 74/29 |
| 2009/0274493 | A1 | 11/2009 | Ishikawa et al. | | |

FOREIGN PATENT DOCUMENTS

| | | | |
|---|---|---|---|
| JP | 2005-90466 | A | 4/2005 |
| JP | 2007-237863 | A | 9/2007 |
| JP | 2009-288763 | A | 12/2009 |
| JP | 2010-286709 | A | 12/2010 |
| JP | 5374524 | B2 | 12/2013 |
| WO | WO-2015159763 | A1 * | 10/2015 |

* cited by examiner

ELECTRIC AIR PUMP

TECHNICAL FIELD

The present disclosure relates to an electric air pump.

BACKGROUND ART

Japanese Patent No. 5374524 discloses a compressor device including an electric air pump. This electric air pump is configured including a motor, a piston that is coupled to the motor through a crank, and a cylinder that houses the piston. In the electric air pump of Japanese Patent No. 5374524, driving the motor moves the piston back and forth within the cylinder, thereby supplying air in the cylinder to another device.

SUMMARY OF INVENTION

Technical Problem

However, in the electric air pump according to Japanese Patent No. 5374524, since the axis line of the motor and the axis line of the cylinder cross in orthogonal directions, the size of the electric air pump is large.

The present disclosure provides an electric air pump that can be made more compact in size.

Solution to Problem

In a first aspect of the present disclosure, an electric air pump includes a motor, a crank, and a piston. The motor includes a rotary shaft provided with a worm. The crank includes a worm wheel which engages with the worm and a rod with one end rotatably coupled to the worm wheel. The piston is housed in a cylinder extending along an axial direction of the motor, is coupled to another end of the rod and moves back and forth along an extension direction of the cylinder due to actuation of the crank, and ejects air inside the cylinder from a valve provided at one end of the cylinder due to being moved toward the one end side of the cylinder.

In the electric air pump of the first aspect, the worm is provided to the rotary shaft of the motor. The worm wheel configuring the crank engages with the worm, and the one end of the rod configuring the crank is rotatably coupled to the worm wheel. The other end of the rod is coupled to the piston.

The piston is housed in the cylinder, and the piston moves back and forth along the extension direction of the cylinder due to actuation of the crank. The piston ejects air inside the cylinder from the valve provided at the one end of the cylinder due to being moved toward the one end side of the cylinder.

Note that the cylinder extends along the axial direction of the motor. The size of the electric air pump can therefore be made more compact along the radial direction of the motor, as compared to configurations in which the cylinder extends along the radial direction of the motor.

A second aspect of the present disclosure is an electric air pump, in the first aspect, at which the cylinder is disposed at a radial direction outer side of the motor so as to adjoin a motor housing portion which houses the motor.

In the second aspect, the cylinder is disposed at the radial direction outer side of the motor so as to adjoin the motor housing portion housing the motor. The cylinder can thus be disposed utilizing space at the radial direction outer side of the motor. The size of the electric air pump can therefore be made more compact along the axial direction of the motor.

A third aspect of the present disclosure is an electric air pump, in the first aspect or the second aspect, at which as viewed along an axial direction of the worm wheel, an axis line of the crank and an axis line of the cylinder are offset in a radial direction of the motor.

In the third aspect, the piston is able to be efficiently pushed out toward the one end side of the cylinder by the rod. Namely, during actuation of the crank, the rod is moved back and forth while swinging about its other end. Since the axis line of the crank and the axis line of the cylinder are offset, it is possible to reduce the swing angle of the rod when the piston is moved toward the one end side of the cylinder, as compared to a comparative example in which the axis line of the crank is, for example, aligned with the axis line of the cylinder. In other words, in contrast to the comparative example, the rod is able to be moved toward the one end side of the cylinder so as to run along the axis line of the cylinder. The piston is therefore able to be efficiently pushed out toward the one end side of the cylinder by the rod.

A fourth aspect of the present disclosure is an electric air pump, in the third aspect, at which as viewed along the axial direction of the worm wheel, the axis line of the crank is disposed between the axis line of the cylinder and an axis line of the motor.

In the fourth aspect, the axis line of the crank is disposed between the axis line of the cylinder and the axis line of the motor, enabling the size of the electric air pump to be made even more compact along the radial direction of the motor.

A fifth aspect of the present disclosure is an electric air pump, in any one of the first aspect to the fourth aspect, at which the rod is disposed on one axial direction side of the worm wheel, and a circuit board configuring a drive circuit that drives the motor is disposed on another axial direction side of the worm wheel.

In the fifth aspect, the crank and the circuit board are able to be disposed alongside each other along the axial direction of the worm wheel. This enables the size of the electric air pump to be made more compact along the axial direction of the worm wheel.

A sixth aspect of the present disclosure is an electric air pump, in any one of the first aspect to the fifth aspect, at which a portion of the rod facing the worm wheel along the direction of the rotary axis of the worm wheel extends linearly along a rotation radial direction of the worm wheel as viewed from a rotation radial direction outer side of the worm wheel.

In the sixth aspect, the space in which the rod is disposed can achieve greater space efficiency, as compared to cases in which a bent portion is formed to the rod to avoid the rotary shaft of the worm wheel. As a result, the electric air pump can be made more compact.

A seventh aspect of the present disclosure is an electric air pump, in any one of the first aspect to the sixth aspect, at which a space where the crank is disposed, and a space where a circuit board configuring a drive circuit that drives the motor is disposed, are disposed adjacent to each other along the direction of the rotary axis of the worm wheel, and the space where the crank is disposed, and the space where the circuit board is disposed, are disposed so as to overlap the piston along the direction of movement of the piston.

In the seventh aspect, the space where the crank is disposed, and the space where the circuit board is disposed, are disposed so as to overlap the piston along the direction of movement of the piston. Such placement enables the electric air pump to be made more compact along the direction of the rotary axis of the worm wheel.

DESCRIPTION OF EMBODIMENTS

Explanation follows regarding an electric air pump 10 according to an exemplary embodiment, with reference to the drawings. The electric air pump 10 is configured as an electric air pump installed in a vehicle (automobile). For example, the electric air pump 10 is configured as an electric air pump connected to an air blower that blows air on an onboard camera (lens) attached to the back door of a vehicle so as to supply air to the air blower. Detailed explanation thereof follows. Note that in the following explanation, arrow A and arrow B illustrated in FIG. 4 indicate an vertical direction of the electric air pump 10. Further, in FIG. 1 to FIG. 3, a direction indicated by arrow C and arrow D that is orthogonal to the vertical direction is referred to as a first direction, and a direction indicated by arrow E and arrow F that is orthogonal to the first direction is referred to as a second direction.

Figure 1:
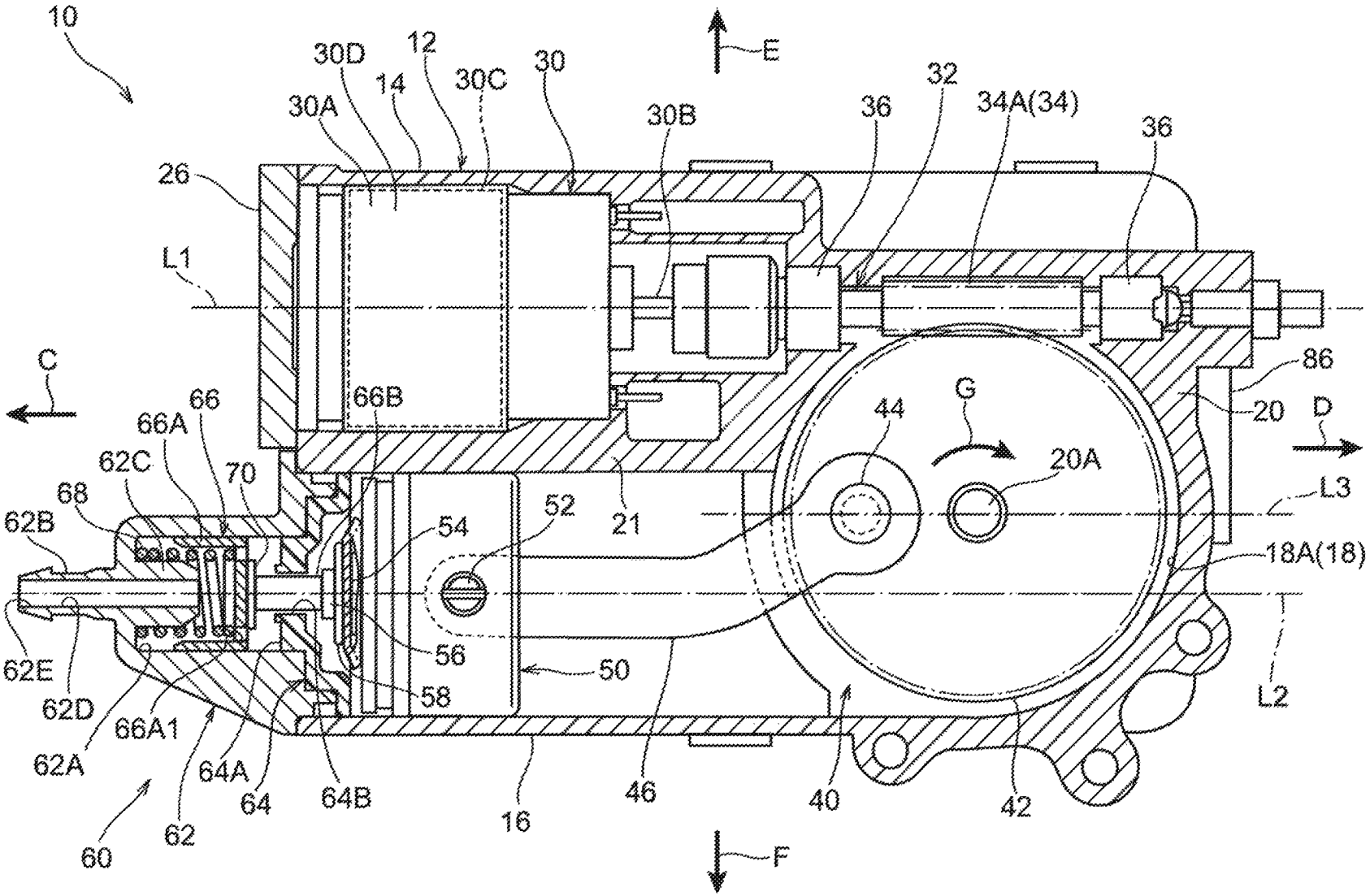
FIG. 1 is a plan view cross-section illustrating an electric air pump according to an exemplary embodiment in a state in which a piston has reached the bottom dead center.
Figure 2:
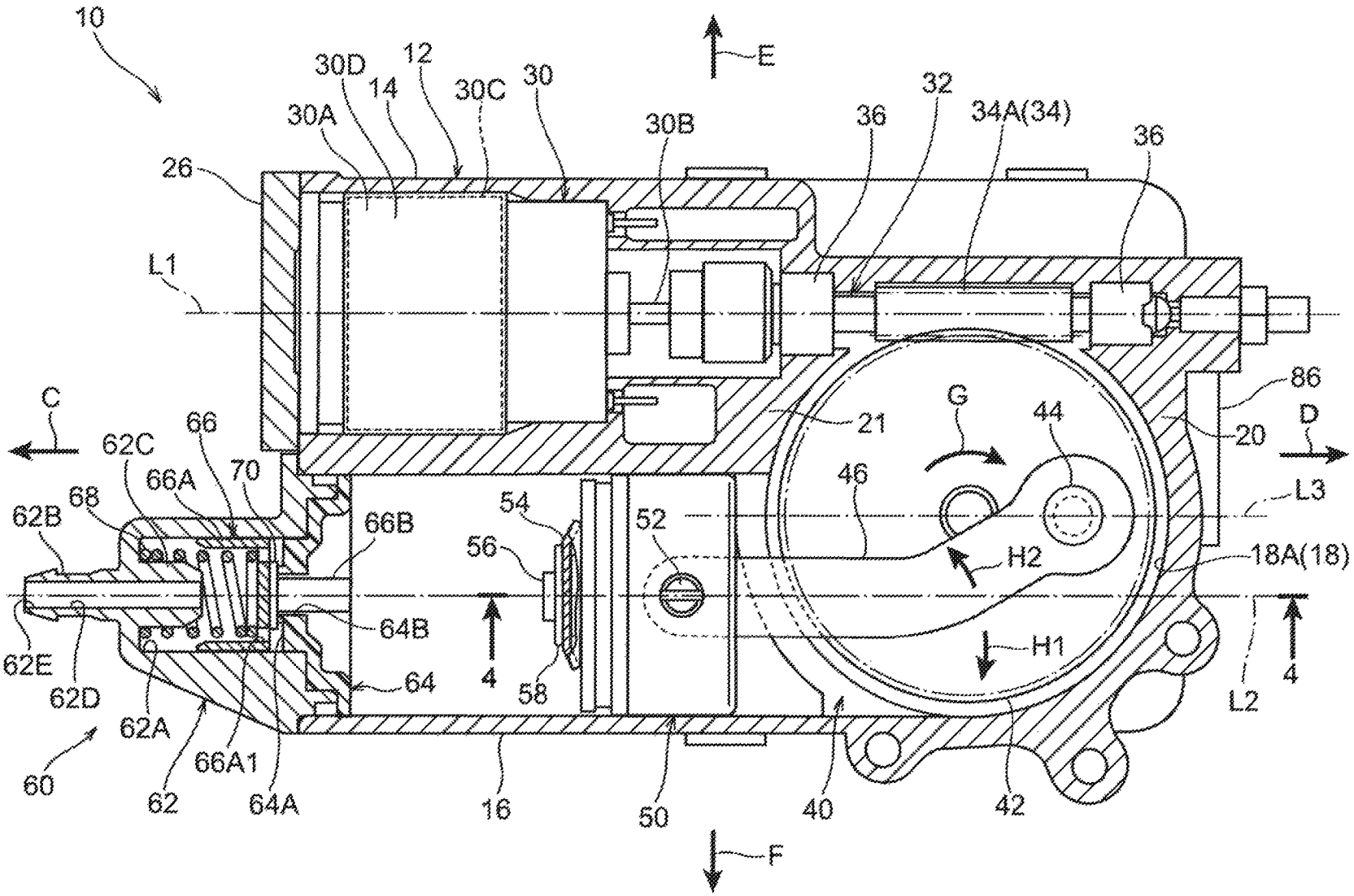
FIG. 2 is a plan view cross-section illustrating the electric air pump depicted in FIG. 1 in a state in which the piston has reached the top dead center.
Figure 3:
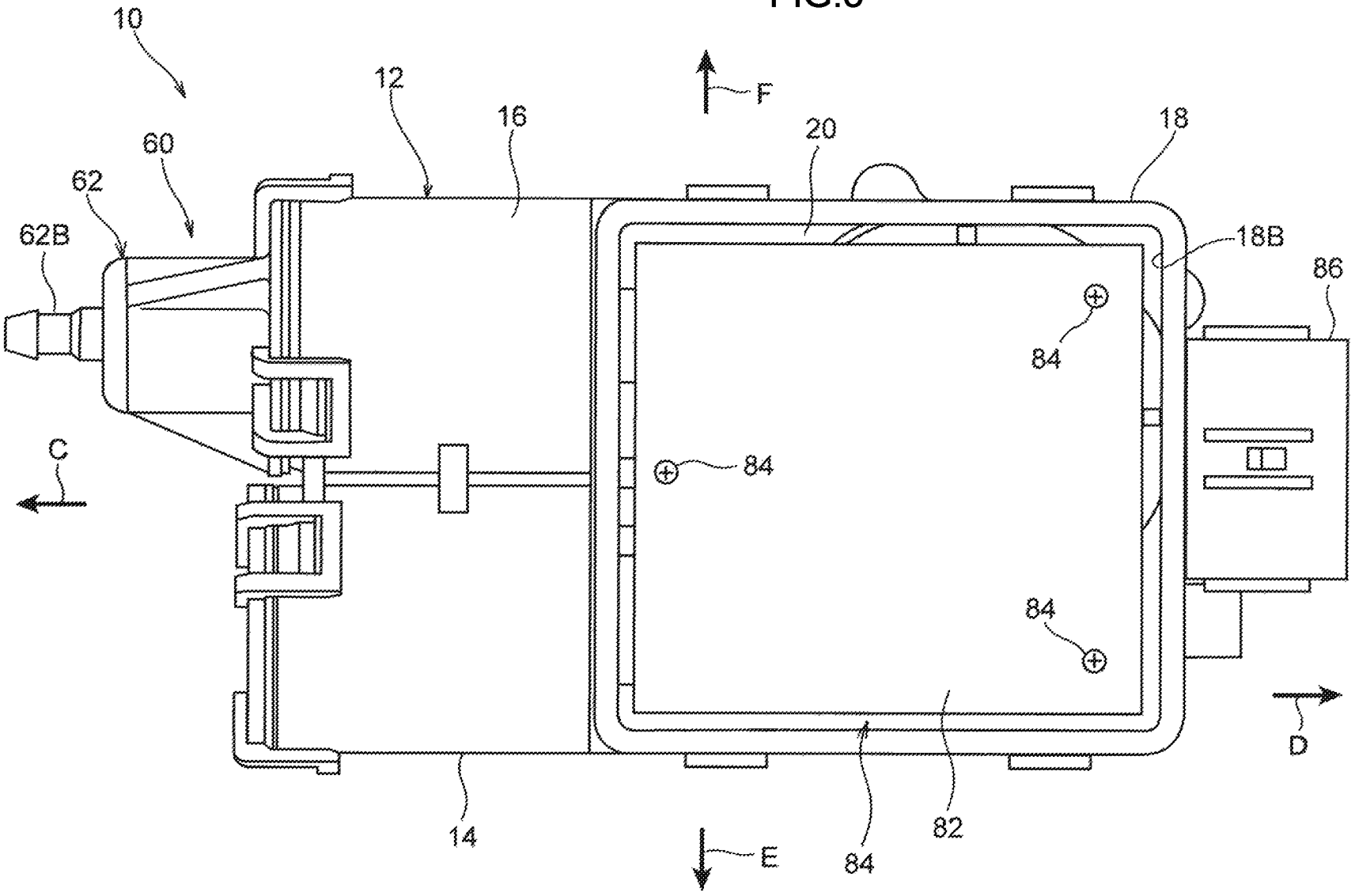
FIG. 3 is a lower face view illustrating the electric air pump depicted in FIG. 1 in a state in which a second cover has been removed, as viewed from a lower side.

As illustrated in FIG. 1 to FIG. 3, the electric air pump 10 is configured including a housing 12, a motor 30 (see FIG. 1 and FIG. 2), a crank 40 (see FIG. 1 and FIG. 2), a check valve 60, and a drive circuit 80 (see FIG. 3). The housing 12 configures an outer shell of the electric air pump 10. The crank 40 is for transmitting drive force from the motor 30 to a piston 50. The check valve 60 is a valve for discharging (ejecting) air from the electric air pump 10. The drive circuit 80 is for controlling driving of the motor 30. Explanation follows regarding the respective configurations thereof in the electric air pump 10.

Housing 12

The housing 12 is formed in a substantially rectangular shape with its length direction in the first direction in plan view as seen from the upper side, and is configured as a hollow structural body. The housing 12 includes a motor housing portion 14, a cylinder 16, and a crank/circuit housing portion 18. The motor housing portion 14 houses the motor 30, described below. The cylinder 16 houses the piston 50, described below. The crank/circuit housing portion 18 houses the crank 40 and the drive circuit 80 (circuit board 82), described below.

The motor housing portion 14 configures a portion at one first direction side (the arrow C direction side in FIG. 1 to FIG. 3) and one second direction side (the arrow E direction side in FIG. 1 to FIG. 3) of the housing 12. The motor housing portion 14 is formed in substantially a circular tube shape with its axial direction along the first direction.

The cylinder 16 is disposed at the other second direction side (the arrow F direction side in FIG. 1 to FIG. 3) of the housing 12 so as to adjoin the motor housing portion 14. The cylinder 16 is formed in substantially a circular tube shape with its axial direction along the first direction, and is integrally formed to the motor housing portion 14. Namely, the cylinder 16 and the motor housing portion 14 are disposed side-by-side in the second direction (a radial direction of the motor housing portion 14) running parallel to each other. An axis line L1 of the motor housing portion 14 (see FIG. 1 and FIG. 2) and an axis line L2 of the cylinder 16 (see FIG. 1 and FIG. 2) are thereby disposed running parallel to each other.

Figure 4:
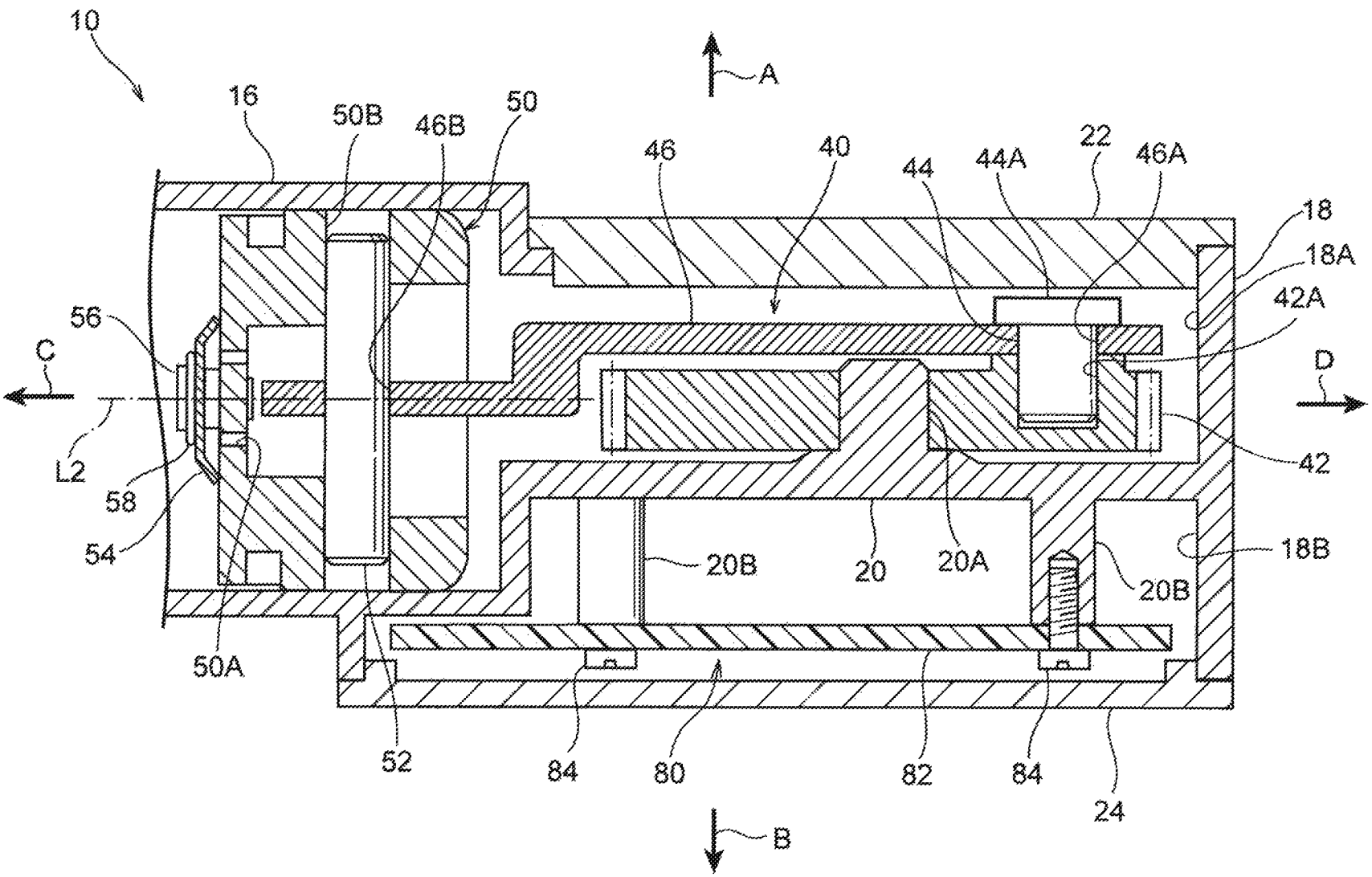
FIG. 4 is an enlarged side view cross-section (a cross-section along line 4-4 in FIG. 2) illustrating the interior of the crank/circuit housing portion depicted in FIG. 2.

The crank/circuit housing portion 18 is disposed at the other first direction side (the arrow D direction side in FIG. 1 to FIG. 3) of the housing 12 so as to adjoin the motor housing portion 14 and the cylinder 16. As illustrated in FIG. 3, the crank/circuit housing portion 18 is formed in substantially a rectangular tube shape that opens in the vertical direction, and is integrally formed to the motor housing portion 14 and the cylinder 16. As illustrated in FIG. 4, the crank/circuit housing portion 18 is provided with a dividing wall 20 that divides the inside of the crank/circuit housing portion 18 in the vertical direction. And end of the dividing wall 20 on the side of the motor housing portion 14 (not illustrated in FIG. 4) and the cylinder 16 is bent toward the lower side in substantially a crank shape, and is integrally formed to the motor housing portion 14 and the cylinder 16. A portion at the upper side (the arrow A direction side in FIG. 4) of the division by the dividing wall 20 in the crank/circuit housing portion 18 configures a crank housing portion 18A. The inside of the crank housing portion 18A is in communication with the insides of the motor housing portion 14 and the cylinder 16. An opening in the crank housing portion 18A is closed off by a first cover 22. A portion at the lower side (the arrow B direction side in FIG. 4) of the division by the dividing wall 20 in the crank/circuit housing portion 18 configures a circuit housing portion 18B. An opening in the circuit housing portion 18B is closed off by a second cover 24. Namely, in the present exemplary embodiment, the dividing wall 20 is disposed so as to serve as a boundary between the crank housing portion 18A and the circuit housing portion 18B, such that the crank housing portion 18A and the circuit housing portion 18B overlap in the vertical direction.

A shaft 20A for axially supporting a worm wheel 42, described below, is integrally formed to the dividing wall 20. The shaft 20A is formed in a circular column shape projecting toward the upper side from the dividing wall 20. The shaft 20A is disposed between the axis line L1 of the motor housing portion 14 and the axis line L2 of the cylinder 16 in plan view (see FIG. 1). Plural bosses 20B (three locations in the present exemplary embodiment) for fixing the circuit board 82, described below, to the dividing wall 20 are integrally formed to the dividing wall 20. The bosses 20B are formed in circular column shapes projecting toward the lower side from the dividing wall 20. A recess open toward the lower side is formed in a central portion of a lower face (leading end face) of each boss 20B.

A dividing wall 21 is provided between the motor housing portion 14 and the crank housing portion 18A. The dividing wall 21 partitions the motor housing portion 14 and the crank housing portion 18A, and suppresses grease from the crank housing portion 18A side from flying into the motor housing portion 14.

Motor 30

As illustrated in FIG. 1 and FIG. 2, the motor 30 is configured as what is known as a brushed DC motor. The motor 30 includes a substantially circular column shaped motor body 30A. A magnet 30C is fixed to an inner peripheral surface of the motor body 30A. The motor body 30A also includes a yoke housing 30D, this being a magnetic body attached to (wrapped around) a portion of the outer peripheral surface of the motor body 30A where the magnet 30C is fixed.

The motor body 30A is disposed in the housing 12 so as to be coaxial with the motor housing portion 14, and is fitted inside the motor housing portion 14. A rotary shaft 30B of the motor 30 extends toward the other first direction side (the crank housing portion 18A side) from the motor body 30A. The axis line of the motor 30 is therefore aligned with the axis line L1 of the motor housing portion 14, and the cylinder 16 described above extends along the axial direction of the motor 30. One length direction end of the motor housing portion 14 (arrow C direction side end in FIG. 1 and FIG. 2) is closed off by a substantially circular disc shaped cap 26.

A worm shaft 32 is provided at the other first direction side (the crank/circuit housing portion 18 side) of the rotary shaft 30B. The worm shaft 32 is disposed so as to be coaxial with the rotary shaft 30B. One axial direction side (rotary shaft 30B side) end of the worm shaft 32 is coupled to a leading end of the rotary shaft 30B so as to be capable of rotating as a unit therewith. The worm shaft 32 is rotatably supported by a pair of bearings 36 at both length direction ends. The pair of bearings 36 are fixed to portions of the dividing wall 20 on the crank housing portion 18A side. A worm 34 is integrally formed to a length direction intermediate portion of the worm shaft 32, and a worm gear 34A is formed around the outer circumference of the worm 34. In the present disclosure, "a rotary shaft provided with a worm" thus encompasses cases in which the worm 34 is provided separately to the rotary shaft 30B. Note that although the worm shaft 32 and the rotary shaft 30B are configured by separate bodies in the present exemplary embodiment, the worm shaft 32 and the rotary shaft 30B may be configured as a single unit.

Crank 40

The crank 40 is configured including the worm wheel 42 and a rod 46. The worm wheel 42 is formed in a substantially circular disc shape with its axial direction in the vertical direction, and is rotatably supported by the shaft 20A of the housing 12. The worm wheel 42 is thus housed within the crank housing portion 18A. An outer circumferential portion of the worm wheel 42 engages with the worm 34 on the worm shaft 32 of the motor 30. Note that the worm wheel 42 and the worm 34 are coated with a lubricating grease. A crank pin 44 for coupling the rod 46, described below, to the worm wheel 42 is also provided to the worm wheel 42. The crank pin 44 is formed in a substantially circular column shape projecting toward the upper side from the worm wheel 42 (see FIG. 4). In detail, as illustrated in FIG. 4, a recessed support hole 42A that is open toward the upper side is formed in the worm wheel 42. The crank pin 44 is fitted into the support hole 42A through one end of the rod 46 and is supported by the support hole 42A. An upper end of the crank pin 44 is integrally formed with a large-diameter portion 44A that has a larger diameter than the diameter of the crank pin 44. The rod 46 is thereby suppressed from coming off from the crank pin 44 toward the axial direction upper side of the crank pin 44 (arrow A direction side in FIG. 4).

As illustrated in FIG. 1 and FIG. 2, the rod 46 is formed in substantially an elongated plate shape with its plate thickness direction along the vertical direction. The rod 46 extends along the first direction (the extension direction of the cylinder 16). The portion of the rod 46, facing the worm wheel 42 (the portion facing the worm wheel 42 along the direction of the rotary axis of the worm wheel 42), is bent into substantially a V shape that opens toward the motor housing portion 14 side in plan view, and is not bent in the vertical direction (plate thickness direction). A portion on one end side of the rod 46 is disposed at the upper side of the worm wheel 42, and the one end of the rod 46 is supported by the crank pin 44, which has its axial direction along the vertical direction, so as to be capable of rotating. In detail, as illustrated in FIG. 4, a first coupling hole 46A is formed penetrating the one end of the rod 46. The first coupling hole 46A is disposed so as to be coaxial with the support hole 42A of the worm wheel 42. The dimensions of the outer diameter of the crank pin 44 and the inner diameter of the support hole 42A are set so as to be substantially the same, with the inner diameter of the first coupling hole 46A being set slightly larger than the outer diameter of the crank pin 44. The crank pin 44 is inserted through the first coupling hole 46A and fitted into the support hole 42A. The one end of the rod 46 is thereby supported by the crank pin 44 so as to be capable of rotating. A length direction intermediate portion of the rod 46 is bent toward the lower side into substantially a crank shape at a position to the radial direction outer side of the worm wheel 42. A portion on the other end side of the rod 46 is disposed in the cylinder 16, and the other end of the rod 46 is coupled to the piston 50, described below. A portion of the rod 46 facing the worm wheel 42 (a portion facing the worm wheel 42 along the direction of the rotary axis of the worm wheel 42), as viewed from a rotation radial direction outer side of the worm wheel 42, extends linearly along a rotation radial direction of the worm wheel 42 and is parallel to the face of the worm wheel 42. The rod 46 and the shaft 20A are disposed with a predetermined clearance therebetween.

Piston 50

As illustrated in FIG. 1, FIG. 2, and FIG. 4, the piston 50 is formed in substantially a bottomed circular tube shape that is open toward the other first direction side. The piston 50 is disposed so as to be coaxial with the cylinder 16, and is housed within the cylinder 16 so as to be capable of movement. The axis line of the piston 50 is thus aligned with the axis line L2 of the cylinder 16. Note that the outer diameter of the piston 50 is set so as to be substantially the same dimension as the inner diameter of the cylinder 16, with a non-illustrated sealing member being interposed between the piston 50 and the cylinder 16. The piston 50 is disposed spanning from the crank housing portion 18A to the circuit housing portion 18B in the vertical direction. In other words, the crank housing portion 18A and the circuit housing portion 18B are disposed so as to overlap with the piston 50 along the direction of movement of the piston 50.

A coupling shaft 52 with its axial direction along the vertical direction is fixed to the inside of the piston 50. The coupling shaft 52 is disposed such that the axis line of the coupling shaft 52 passes through the axis line L2 of the piston 50. The other end of the rod 46 described above is disposed inside the piston 50 and is rotatably coupled to the coupling shaft 52. The piston 50 is thereby coupled to the crank 40. In detail, a fixing hole 50B is formed penetrating an axial direction intermediate portion of the piston 50 in the vertical direction. A second coupling hole 46B is formed penetrating the other end of the rod 46. The second coupling hole 46B is disposed so as to be coaxial with the fixing hole 50B. The dimensions of the inner diameter fixing hole 50B and the outer diameter of the coupling shaft 52 are set so as to be substantially the same, with the inner diameter of the second coupling hole 46B being set slightly larger than the outer diameter of the coupling shaft 52. The coupling shaft 52 is fitted into the fixing hole 50B and inserted through the second coupling hole 46B. The other end of the rod 46 is thereby pivotally coupled to the coupling shaft 52.

When the motor 30 is driven to actuate the crank 40, the piston 50 moves back and forth along the axis line L2 of the cylinder 16. Specifically, rotating the rotary shaft 30B of the motor 30 in one rotary direction (forward rotation) rotates the worm wheel 42 in one rotary direction (the arrow G direction in FIG. 1 and FIG. 2) about the shaft 20A such that the rod 46 moves the piston 50 back and forth along the axis line L2 of the cylinder 16 (the first direction). The axis line L3 of the crank 40 (specifically, a line passing through the center of rotation of the worm wheel 42 and extending along the direction of movement of the piston 50 (the first direction)) is set so as to extend parallel to the axis line L2 of the piston 50 (cylinder 16) and the axis line L1 of the motor 30 between the axis line L2 of the piston 50 and the axis line L1 of the motor 30. Namely, the axis line L3 of the crank 40 is disposed offset toward the one second direction side (the motor 30 side) with respect to the axis line L2 of the piston 50 (cylinder 16). In the following explanation, a position where the piston 50 has been moved furthest toward the one first direction side (one end side of the cylinder 16) is referred to as the bottom dead center (the position illustrated in FIG. 1), and a position where the piston 50 has been moved furthest toward the other first direction side (the other end side of the cylinder 16) is referred to as the top dead center (the position illustrated in FIG. 2). The piston 50 moves toward the one first direction side (the piston 50 moves from the top dead center to the bottom dead center) in an outbound stroke, and the piston 50 moves toward the other first direction side (the piston 50 moves from the bottom dead center to the top dead center) in a return stroke.

As described above, the rod 46 is bent into substantially a V shape that is open toward the motor housing portion 14 side in plan view. Accordingly, due to the bent portion of the rod 46, the rod 46 thus does not interfere with the motor housing portion 14 when the crank 40 is being actuated.

As illustrated in FIG. 4, plural intake ports 50A are formed penetrating a central portion of one end (a bottom wall) of the piston 50. The inside of the piston 50 (the inside of the crank housing portion 18A) and the inside of the cylinder 16 are placed in communication through the intake ports 50A. An intake valve 54 with substantially an umbrella shape is provided at the one first direction side of the piston 50. Specifically, the intake valve 54 is formed in substantially a circular plate shape with its plate thickness direction along the axial direction of the piston 50. An outer circumferential portion of the intake valve 54 is inclined toward the piston 50 side on progression toward the radial direction outer side thereof. The intake valve 54 is attached to the one end (the bottom wall) of the piston 50 by a screw 56. The head of the screw 56 is disposed on the one first direction side of the intake valve 54. A washer 58 is interposed between the head of the screw 56 and the intake valve 54. The intake valve 54 is configured as a check valve. Namely, during the outbound stroke of the piston 50, the outer circumferential portion of the intake valve 54 abuts the one end of the piston 50 and the intake valve 54 adopts a closed state. During the return stroke of the piston 50, the outer circumferential portion of the intake valve 54 opens (comes away from the one end of the piston 50), drawing air is into the cylinder 16 through the intake ports 50A, due to the pressure within the cylinder 16 dropping such that air drawn from outside the electric pump 10 flows into the cylinder 16.

Check Valve 60

As illustrated in FIG. 1 and FIG. 2, the check valve 60 is configured including a valve body 62, a cap 64, a stopper 66, a stopper spring 68, and a valve 70. The valve body 62 is formed in substantially a bottomed circular tube shape that is open toward the other first direction side. An opening end of the valve body 62 is fitted into the one end of the cylinder 16. The one end of the cylinder 16 is thereby closed off by the valve body 62. A stopper housing portion 62A for housing the stopper 66, described below, is formed inside the valve body 62. The stopper housing portion 62A is formed with a recessed shape that is open toward the cylinder 16 side, and the stopper housing portion 62A is formed with a substantially circular cross-section profile as taken in the second direction.

A substantially circular tube shaped connection portion 62B is integrally formed to a bottom wall of the valve body 62. The connection portion 62B is disposed so as to be coaxial with the axis line L2 of the cylinder 16, and projects toward the one first direction side (one axial direction side of the cylinder 16) from the bottom wall of the valve body 62. A non-illustrated hose is connected to the connection portion 62B. Air is supplied to the hose from the electric air pump 10 such that air is supplied to the air blower.

A substantially circular tube shaped attachment tube 62C for attaching the stopper spring 68, described below, is integrally formed to the bottom wall of the valve body 62. The attachment tube 62C is disposed so as to be coaxial with the connection portion 62B, and projects toward the stopper housing portion 62A side. The insides of the connection portion 62B and the attachment tube 62C are in communication with one another, and this communicated portion configures an exhaust path 62D. The outside of the electric air pump 10 (inside the hose) is placed in communication with the stopper housing portion 62A through the exhaust path 62D. Further, an opening end on the connection portion 62B side of the exhaust path 62D configures an exhaust port 62E.

The cap 64 is formed in a comparatively shallow-bottomed, circular tube shape that is open toward the other first direction side. The cap 64 is disposed inside the one end of the cylinder 16, and is fitted into the opening end of the valve body 62. A bottom wall of the cap 64 is formed with a projection 64A that projects toward the one first direction side. The projection 64A is fitted into the opening end of the stopper housing portion 62A. A substantially circular exhaust hole 64B is formed penetrating the projection 64A. The exhaust hole 64B is disposed so as to be coaxial with the axis line L2 of the cylinder 16.

The stopper 66 includes a bottomed, circular tube shaped stopper body 66A that is open toward the one first direction side. The stopper body 66A is housed within the stopper housing portion 62A of the valve body 62 so as to be capable of movement in the first direction (the axial direction of the cylinder 16). The stopper 66 is thus configured so as to be capable of moving between an open position illustrated in FIG. 1 and a closed position illustrated in FIG. 2. Plural communication holes 66A1 are formed in a bottom wall of the stopper body 66A. The communication holes 66A1 are disposed side-by-side around the circumferential direction of the stopper body 66A, and are disposed at the radial direction outer side of the exhaust hole 64B of the cap 64 described above.

The stopper spring 68 is provided between the bottom wall of the stopper body 66A and the bottom wall of the valve body 62 in a state deformed by compression. The stopper spring 68 is configured by a compression coil spring. The attachment tube 62C is inserted into one end of the stopper spring 68. The other end of the stopper spring 68 is disposed inside the stopper body 66A so as to abut the bottom wall of the stopper body 66A. The stopper 66 is thereby biased toward the other axial direction side (cap 64 side) of the cylinder 16 by the stopper spring 68 so as to be disposed in the closed position.

A substantially circular column shaped stopper shaft 66B is integrally formed to a central portion of the bottom wall of the stopper body 66A. The stopper shaft 66B projects toward the cap 64 side from the bottom wall of the stopper body 66A. The outer diameter of the stopper shaft 66B is set so as to be smaller than the inner diameter of the exhaust hole 64B, and the stopper shaft 66B is inserted through the exhaust hole 64B. When the piston 50 has reached the bottom dead center, the head of the screw 56 of the piston 50 presses a leading end of the stopper shaft 66B toward the one first direction side such that the stopper 66 moves to the open position.

The valve 70 is formed in substantially an annular plate shape. The stopper shaft 66B is fitted into the valve 70, and the valve 70 is disposed at the radial direction outer side of a base end of the stopper shaft 66B. The outer diameter of the valve 70 is set so as to be larger than the inner diameter of the exhaust hole 64B. Thus, in a state in which the stopper 66 is disposed at the closed position, the exhaust hole 64B is closed off by the valve 70. The valve 70 is disposed at the radial direction inner side of the communication holes 66A1 of the stopper body 66A. In other words, the outer diameter of the valve 70 is set so as to be disposed at the radial direction inner side of the communication holes 66A1. Thus, moving the stopper 66 toward the open position side opens the exhaust hole 64B such that the inside of the cylinder 16 and the outside of the electric air pump 10 are in communication with each other through the exhaust hole 64B, the communication holes 66A1, and the exhaust path 62D.

Drive Circuit 80

As illustrated in FIG. 3 and FIG. 4, the drive circuit 80 is configured as a circuit that controls driving of the motor 30 described above. The drive circuit 80 includes the substantially rectangular plate shaped circuit board 82. The circuit board 82 is housed within the circuit housing portion 18B with its plate thickness direction in the vertical direction (the axial direction of the worm wheel 42). Specifically, the circuit board 82 is placed on leading ends of the bosses 20B of the dividing wall 20 in the housing 12. Screws 84 are screwed into the recesses in the bosses 20B. The circuit board 82 is thereby fixed to the housing 12 by the screws 84. A connector 86 that supplies electric power to the drive circuit 80 is mounted on the circuit board 82. The connector 86 projects toward the other first direction side from the housing 12. The circuit board 82 is electrically connected to the motor 30. Non-illustrated electronic components that control driving of the motor 30 are mounted on the circuit board 82. Driving of the motor 30 is thus controlled by the drive circuit 80.

Explanation follows regarding operation of the present exemplary embodiment.

In the electric air pump 10 configured as described above, when the motor 30 is driven by the drive circuit 80, the rotary shaft 30B of the motor 30 is rotated in one rotary direction (rotated forward). The worm shaft 32 provided to the rotary shaft 30B so as to be capable of rotating as a unit therewith thus rotates in the one rotary direction, actuating the crank 40. Specifically, the worm wheel 42 rotates in one rotary direction about the shaft 20A, and the piston 50 coupled thereto by the rod 46 moves back and forth between the bottom dead center and the top dead center along the axial direction of the cylinder 16.

Movement of Piston 50 from Top Dead Center to Bottom Dead Center

As illustrated in FIG. 2, in a state in which the piston 50 is disposed at the top dead center, the piston 50 is disposed away from the check valve 60, on the other first direction side thereof. Thus, in the check valve 60, the stopper 66 is disposed at the closed position due to biasing force from the stopper spring 68, and the exhaust hole 64B is closed off by the valve 70. On the outbound stroke of the piston 50 from the top dead center to the bottom dead center, air in the cylinder 16 is compressed as a result of the outbound movement of the piston 50. During this time, the state in which the exhaust hole 64B is closed off by the valve 70 is maintained due to the biasing force of the stopper spring 68.

As illustrated in FIG. 1, when the piston 50 has reached the bottom dead center, the head of the screw 56 provided at the one end side of the piston 50 presses the leading end of the stopper shaft 66B toward the one first direction side against the biasing force of the stopper spring 68. The stopper 66 is thereby moved from the closed position to the open position, ending the state in which the exhaust hole 64B is closed off by the valve 70, and opening the exhaust hole 64B. The inside of the cylinder 16 and the outside of the electric air pump 10 are thus placed in communication with each other through the exhaust hole 64B, the communication holes 66A1, and the exhaust path 62D. As a result, compressed air inside the cylinder 16 is discharged (ejected) through the exhaust port 62E into the hose and supplied to the air blower via the hose.

Movement of Piston 50 from Bottom Dead Center to Top Dead Center

On the return stroke of the piston 50 from the bottom dead center, the head of the screw 56 provided at the one end side of the piston 50 moves away from the leading end of the stopper shaft 66B, toward the other first direction side thereof. The stopper 66 is thus moved from the open position to the closed position by biasing force from the stopper spring 68, and the exhaust hole 64B is closed off by the valve 70. During the return stroke of the piston 50, the outer circumferential portion of the intake valve 54 to opens, drawing air is drawn into the cylinder 16, due to the pressure within the cylinder 16 dropping such that air drawn in from outside the electric pump 10 flows into the cylinder 16. When the piston 50 has reached the top dead center, a state is adopted in which air has been drawn into the cylinder 16.

In the electric air pump 10, when the motor 30 is driven, the piston 50 moves back and forth between the top dead center and the bottom dead center such that compressed air inside the cylinder 16 is supplied to the air blower via the hose.

Note that in the electric air pump 10, the housing 12 configuring an outer shell of the electric air pump 10 is configured including the motor housing portion 14 housing the motor 30 and the cylinder 16 housing the piston 50. The cylinder 16 extends along the axial direction of the motor 30. This enables the size of the electric air pump 10 to be made more compact along the radial direction of the motor 30, as compared to configurations in which the cylinder 16 extends along the radial direction of the motor 30 (a direction orthogonal to the axis line L1 of the motor 30) such as described in Background Art.

Further, the cylinder 16 is disposed at the radial direction outer side of the motor housing portion 14 so as to adjoin the motor housing portion 14. Specifically, the cylinder 16 and the motor housing portion 14 are disposed side-by-side in the radial direction of the motor 30 (in the second direction) in the housing 12. The cylinder 16 can thus be disposed utilizing space at the radial direction outer side of the motor 30. This enables the size of the electric air pump 10 to be made more compact along the axial direction of the motor 30, as compared to cases in which the cylinder 16 is, for example, disposed at the other first direction side of the crank/circuit housing portion 18.

Further, in the electric air pump 10, as viewed along the axial direction (vertical direction) of the worm wheel 42, the axis line L3 of the crank 40 and the axis line L2 of the cylinder 16 are offset in the second direction. This enables the piston 50 to be efficiently pushed out by the rod 46 when the rod 46 moves the piston 50 from the top dead center to the bottom dead center. Namely, when the piston 50 moves from the top dead center to the bottom dead center, the one end of the rod 46 rotates about the shaft 20A such that the rod 46 moves while swinging about its other end (the portion coupled to the piston 50) (see arrow H1 and arrow H2 in FIG. 2). Since the axis line L3 of the crank 40 and the axis line L2 of the cylinder 16 are offset, it is possible to reduce the swing angle of the rod 46 when the piston 50 is on the outbound stroke, as compared to a comparative example in which the axis line L3 of the crank 40 is, for example, aligned with the axis line L2 of the cylinder 16. In other words, in contrast to the comparative example, the rod 46 is able to be moved along the axis line L2 of the cylinder 16 when the rod 46 moves the piston 50 from the top dead center to the bottom dead center. This enables the piston 50 to be efficiently pushed out by the rod 46 when the rod 46 moves the piston 50 from the top dead center to the bottom dead center.

Further, in the electric air pump 10, as viewed along the axial direction (vertical direction) of the worm wheel 42, the axis line L3 of the crank 40 is disposed between the axis line L2 of the cylinder 16 and the axis line L1 of the motor 30. This enables the size of the electric air pump 10 to be made even more compact along the radial direction of the motor 30, as compared to cases in which the axis line L3 of the crank 40 is disposed on the opposite side of the axis line L2 of the cylinder 16 to the axis line L1 of the motor 30 (the other second direction side).

Further, in the electric air pump 10, the one end side of the rod 46 is disposed on the upper side of the worm wheel 42, and the circuit board 82 is disposed on the other axial direction side of the worm wheel 42. The crank 40 and the circuit board 82 are thus able to be disposed alongside each other along the axial direction of the worm wheel 42. This enables the size of the electric air pump 10 to be made more compact along the axial direction of the worm wheel 42.

Further, the motor 30 configuring part of the electric air pump 10 includes the yoke housing 30D, this being a magnetic body wrapped around locations corresponding to the magnet 30C. The thickness of portions of the yoke housing 30D that contribute little to the magnetic field (for example, a portion where a brush holder is housed) are thus able to be made thinner. This enables the motor 30 to be made more compact, and enables the electric air pump 10 configured including the motor 30 to be made more compact.

Further, in the electric air pump 10, the length direction intermediate portion of the rod 46 is bent toward the lower side (namely, the circuit housing portion 18B side) so as to form substantially a crank shape at a position to the radial direction outer side of the worm wheel 42. In addition, the portion of the rod 46 facing the worm wheel 42 (the portion facing the worm wheel 42 along the direction of the rotary axis of the worm wheel 42), as viewed from a rotation radial direction outer side of the worm wheel 42, extends linearly along a rotation radial direction of the worm wheel 42 and is parallel to the face of the worm wheel 42. This enables the crank housing portion 18A in which the rod 46 is disposed to be achieve greater space efficiency in the vertical direction. As a result, the electric air pump 10 can be made more compact in the vertical direction.

Further, in the electric air pump 10, the piston 50 is disposed spanning from the crank housing portion 18A to the circuit housing portion 18B in the vertical direction. Such configuration enables the electric air pump 10 to be made more compact in the vertical direction.

Note that although the axis line L2 of the cylinder 16 and the axis line L1 of the motor 30 are set so as so run parallel to each other in the present exemplary embodiment, the axis line L2 of the cylinder 16 may be disposed angled slightly with respect to the axis line L1 of the motor 30 as viewed along the vertical direction. Namely, "a cylinder extending along an axial direction of a motor" in the present disclosure encompasses cases in which a cylinder extends along a direction that is angled with respect to an axial direction of a motor. The size of the electric air pump 10 is able to be made more compact along the radial direction of the motor 30 in these cases as well, as compared to configurations in which the cylinder 16 extends along the radial direction of the motor 30 (a direction orthogonal to the axial direction).

Further, although the motor housing portion 14 and the cylinder 16 are set so as to be adjoining in the present exemplary embodiment, configuration may be such that the crank 40 is disposed between the motor housing portion 14 and the cylinder 16 along the length directions thereof as viewed along the vertical direction. The size of the electric air pump 10 is able to be made more compact along the radial direction of the motor in these cases as well, as compared to configurations in which the cylinder 16 extends along the radial direction of the motor 30 (a direction orthogonal to the axial direction).

Further, in the present exemplary embodiment, configuration is such that the rotary shaft 30B of the motor 30 is rotated in one rotary direction to move the piston 50 back and forth between the top dead center and the bottom dead center. Alternatively, configuration may be such that the rotary shaft 30B of the motor 30 is rotated forward and in reverse by the drive circuit 80 to move the piston 50 back and forth between the top dead center and the bottom dead center.

Further, in the present exemplary embodiment, configuration is such that the head of the screw 56 provided to the one first direction side of the piston 50 pushes the stopper shaft 66B to open the check valve 60. Alternatively, configuration may be such that the check valve 60 is opened when the pressure within the cylinder 16 (in the space formed between the cylinder 16 and the piston 50) on the outbound stroke of the piston 50 becomes greater than or equal to a given pressure. In such cases, the biasing force of the stopper spring 68 is set such that the check valve 60 opens when the pressure within the cylinder 16 becomes greater than or equal to the given pressure.

Further, in the configuration of the check valve 60 that opens when the pressure within the cylinder 16 becomes greater than or equal to the given pressure, it is not necessary for the connection portion 62B (the exhaust hole 64B) to be coaxial with the axis line L2 of the cylinder 16. For example, the connection portion 62B (exhaust hole 64B) may be to the radial direction outer side (in a direction orthogonal to the axis line L2 of the cylinder 16) of the cylinder 16.

Further, in the present exemplary embodiment, as illustrated in FIG. 4, configuration is such that the circuit board 82 (circuit housing portion 18B) is disposed overlapping with the cylinder 16 in the vertical direction (the axial direction of the worm wheel 42). Alternatively, configuration may be such that the circuit board 82 is not disposed overlapping with the cylinder 16 in the vertical direction. The size of the electric air pump 10 is able to be made more compact along the vertical direction in these cases as well, as compared to configurations in which the circuit board 82 overlaps with the cylinder 16 in the vertical direction.

The disclosure of Japanese Patent Application No. 2015-226909, filed on Nov. 19, 2015, and the disclosure of Japanese Patent Application No. 2016-146537, filed on Jul. 26, 2016, are incorporated in their entirety in the present specification by reference herein.

All cited documents, patent applications, and technical standards mentioned in the present specification are incorporated by reference in the present specification to the same extent as if each individual cited document, patent application, or technical standard was specifically and individually indicated to be incorporated by reference.

The invention claimed is:

1. An electric air pump comprising:

a motor that includes a rotary shaft provided with a worm;

a crank that includes a worm wheel which engages with the worm and a rod with one end rotatably coupled to the worm wheel; and a piston that is housed in a cylinder extending along an axial direction of the motor, that is coupled to another end of the rod and moves back and forth along an extension direction of the cylinder due to actuation of the crank, and that ejects air inside the cylinder from a valve provided at one end of the cylinder due to being moved toward the one end side of the cylinder; wherein as viewed along an axial direction of the worm wheel, the motor and the piston are disposed at a same side along a direction of movement of the piston, with respect to the worm wheel;

as viewed along the axial direction of the worm wheel, a line passing through a center of rotation of the worm wheel and extending along a direction of movement of the piston is offset from an axis line of the cylinder in a radial direction of the motor; and as viewed along the axial direction of the worm wheel, the line passing through the center of rotation of the worm wheel and extending along the direction of movement of the piston is disposed between the axis line of the cylinder and an axis line of the motor.

2. The electric air pump of claim 1, wherein the cylinder is disposed at a radial direction outer side of the motor so as to adjoin a motor housing portion which houses the motor.

3. The electric air pump of claim 1, wherein:

the rod is disposed on one axial direction side of the worm wheel; and a circuit board configuring a drive circuit that drives the motor is disposed on another axial direction side of the worm wheel.

4. The electric air pump of claim 1, wherein a portion of the rod facing the worm wheel along the direction of the rotary axis of the worm wheel extends linearly along a rotation radial direction of the worm wheel as viewed from a rotation radial direction outer side of the worm wheel.

5. The electric air pump of claim 1, wherein:

a space where the crank is disposed, and a space where a circuit board configuring a drive circuit that drives the motor is disposed, are disposed adjacent to each other along the direction of the rotary axis of the worm wheel; and the space where the crank is disposed, and the space where the circuit board is disposed, are disposed so as to overlap the piston along the direction of movement of the piston.

6. An electric air pump comprising:

a motor that includes a rotary shaft provided with a worm;

a circuit board configuring a drive circuit that drives the motor;

a crank that includes a worm wheel which engages with the worm and a rod with one end rotatably coupled to the worm wheel;

a piston that is housed in a cylinder extending along an axial direction of the motor, that is coupled to another end of the rod and moves back and forth along an extension direction of the cylinder due to actuation of the crank, and that ejects air inside the cylinder from a valve provided at one end of the cylinder due to being moved toward the one end side of the cylinder; and a housing including a motor housing portion which houses the motor, the cylinder, and a crank/circuit housing portion which houses the crank and the circuit board;

wherein the crank/circuit housing portion includes a dividing wall that divides an inside of the crank/circuit housing portion into one direction side and another direction side along an axial direction of the worm wheel, and wherein the worm wheel and the rod are disposed at the one direction side along the axial direction of the worm wheel with respect to the dividing wall, and the circuit board is disposed another direction side along the axial direction of the worm wheel with respect to the dividing wall.

7. The electric air pump of claim 6, wherein the cylinder is disposed at a radial direction outer side of the motor so as to adjoin the motor housing portion.

8. The electric air pump of claim 7, wherein as viewed along the axial direction of the worm wheel, the cylinder is disposed at a one side with respect to an axis line of the motor, the one side at which the worm wheel is disposed.

9. The electric air pump of claim 6, wherein inside the housing, the cylinder extends from a space of the crank/circuit housing portion at which the crank is disposed, to a space of the crank/circuit housing portion at which the circuit board is disposed.

* * * * *